United States Patent [19]

Joy

[11] 3,992,656

[45] Nov. 16, 1976

[54] SIREN DETECTOR

[76] Inventor: Ivan L. Joy, 415 Delaware Drive, Ozawkie, Kans. 66070

[22] Filed: Sept. 11, 1975

[21] Appl. No.: 612,355

[52] U.S. Cl. ..... 317/147; 340/38 S

[51] Int. Cl.[2] ..... G08G 1/04

[58] Field of Search ..... 317/147; 340/33, 38 S, 340/38 R

[56] References Cited

UNITED STATES PATENTS

| | | | |
|---|---|---|---|
| 2,355,607 | 8/1944 | Shepherd | 340/33 |
| 3,715,579 | 2/1973 | Eblovi | 317/147 |

*Primary Examiner*—R. N. Envall, Jr.

*Attorney, Agent, or Firm*—J. Patrick Cagney

[57] ABSTRACT

An audio range siren detector utilizes an audio pickup including an A.G.C. amplifier, a plurality of electronic active filters having closely spaced resonant frequencies such as 800, 825, 850 timing means responsive to an actuating signal from one of the filters for generating a time slot signal of short duration, gating means responsive to each of the filter means for producing an actuating signal, control logic responsive to the occurrence of all actuating signals within the time slot to produce output denoting a valid siren signal, and relay means for setting traffic lights to emergency condition.

The detector includes counters and additional timers to further restrict the conditions under which a valid siren signal will be responded to in order to better discriminate against extraneous ambient noises of all types.

8 Claims, 3 Drawing Figures

SIREN DETECTOR

BACKGROUND OF THE INVENTION

There is a need to assist an emergency vehicle through stoplight intersections, for example, by detecting its presence and temporarily turning all traffic lights at the intersection red to facilitate clearing a safe path for the emergency vehicle. It is unduly expensive to equip each emergency vehicle with a special encoder for actuating the traffic lights.

Since it is traditional to equip each emergency vehicle with a siren either of an electronic or mechanical type, it is much more practical from an economic standpoint to provide suitable means for detecting the sound of the siren for the purpose of temporarily actuating the traffic lights to an emergency mode of operation.

A reliable siren detector must be able to discriminate against substantially all other noises, but experience shows that the siren exhibits an unusually difficult and unique amplitude and frequency pattern during its normal mode of operation. For example, the amplitude of the siren output, due to standing wave effects, varies by a factor of 20. The frequency of the siren signal can jump erratically from 800 cycles to 600 cycles due to standing wave effects. Analysis of the siren output shows that while in numerous situations it sweeps frequency over a prescribed range, there are many unexplained conditions wherein unexpected frequencies can occur at unpredictable times.

Other characteristics of sirens which have been observed and which prove troublesome to reliable detection include the fact that some of the mechanical sirens have cavity units interrelated to the tone generated by the siren wheel so as to make multiples, harmonics and the like in addition to the fundamental tones. Electronic sirens that are designed to duplicate the sound of mechanical sirens have sometimes included inductances in series with their frequency generating elements causing spurious harmonics to be generated and causing the frequency actually to leap from one value to another causing electronic sound detection equipment to pick up a confusing signal pattern.

The frequency pattern of a siren related to its harmonics, multiples, etc., has been found to change with distance of the siren to the microhphone. In addition, the siren sound reverberates between buildings, pavement and various objects and also passes through various standing wave conditions, depending upon the distance between the emergency vehicle and the microphone pick-up. The human ear does not notice many of these frequency jumps and multiples, so that a person, in determining whether a siren wail is in an increasing or decreasing frequency mode is generally unaware of the complexities of the actual sound from the siren.

SUMMARY OF THE INVENTION

This invention provides a siren detector capable of reliably detecting the sound of a siren while effectively discriminating against ambient street noises.

More particularly, the invention provides an audio range siren detector comprising audio pick-up means, at least two narrow pass electronic filter means responsive to the pick-up means and having closely spaced resonance points in the region of fundamental siren frequencies for producing a distictive actuating signal, timing means responsive to one of the actuating signals for generating a timing signal of short duration, gating means responsive to the filter means for producing an actuating signal upon initiation of the actuating signal from each filter means, control means responsive upon the occurrence of a pre-determined pattern comprised of all of the actuating signals within the duration of the timing interval to produce output and utilization means responsive to the output from the control means.

In the preferred practice of the invention, narrow band width filters having fast rise times and having resonant frequencies at increments of 25 cycles (for example resonant frequencies of 800 and 825) are employed in order to provide valid siren detection either for an increasing frequency mode or a decreasing frequency mode even in the presence of talking, music, horns or other street and traffic noises.

BRIEF DESCRIPTION OF THE DRAWINGS

In the accompanying drawings forming a part of the specification, and in which like numerals are employed to designate like parts throughout the same.

DESCRIPTION OF PREFERRED EMBODIMENTS

For purposes of specific disclosure, typical sirens used experimentally in the development of the preferred embodiments disclosed herein include mechanical sirens such as Model Nos. 301 and 303 marketed by Signalstat Corporation and electronic sirens such as Model No. B-678 marketed by Federal Corporation and Model No. T-1300A marketed by Motorola.

Actual siren output can be detected and discriminated from other noises on the basis that the typical siren output sweeps through a restricted range of its fundamental tones such that output from within such range terminates within a brief time interval following initiation of output from within such range.

Typically, the electronic sirens have a relatively uniform frequency excursion spanning a fundamental frequency range from 500 to 1200 cycles per second. Mechanical sirens have more erratic frequency excursion patterns but appear to be relatively uniform in characteristics in the region of 800 to 850 cycles.

Because of the characteristics of the sirens referred to above, the presently preferred practice of the invention which is described herein for purposes of illustrative disclosure utilizes a restricted range of fundamental siren frequencies, typically from 800 to 850 cycles, and a typical time interval during which output at such a frequency range must begin and end is about 200 milliseconds. These frequency values are given with respect to mechanical sirens in common use for which the frequency range is critical and deviations of as little as 50 cycles can cause malfunction, but may be altered depending upon the fundamental tone characteristics of the particular siren.

On the increasing frequency mode, an electronic siren swings in fundamental frequency through the 800 to 850 cycle range in a period of about 50 to 75 milliseconds, while on the decreasing frequency mode, the swing from 850 to 800 cycles occurs in a period about 150 milliseconds or more. Thus, the increasing frequency mode is the critical factor and provides as little as 50 milliseconds for the detection filter to react. In addition to the normal frequency swing characteristics, it has also been observed that the frequency of the siren can jump, for example, from 800 to 600 due to standing wave effects.

Figure 1:
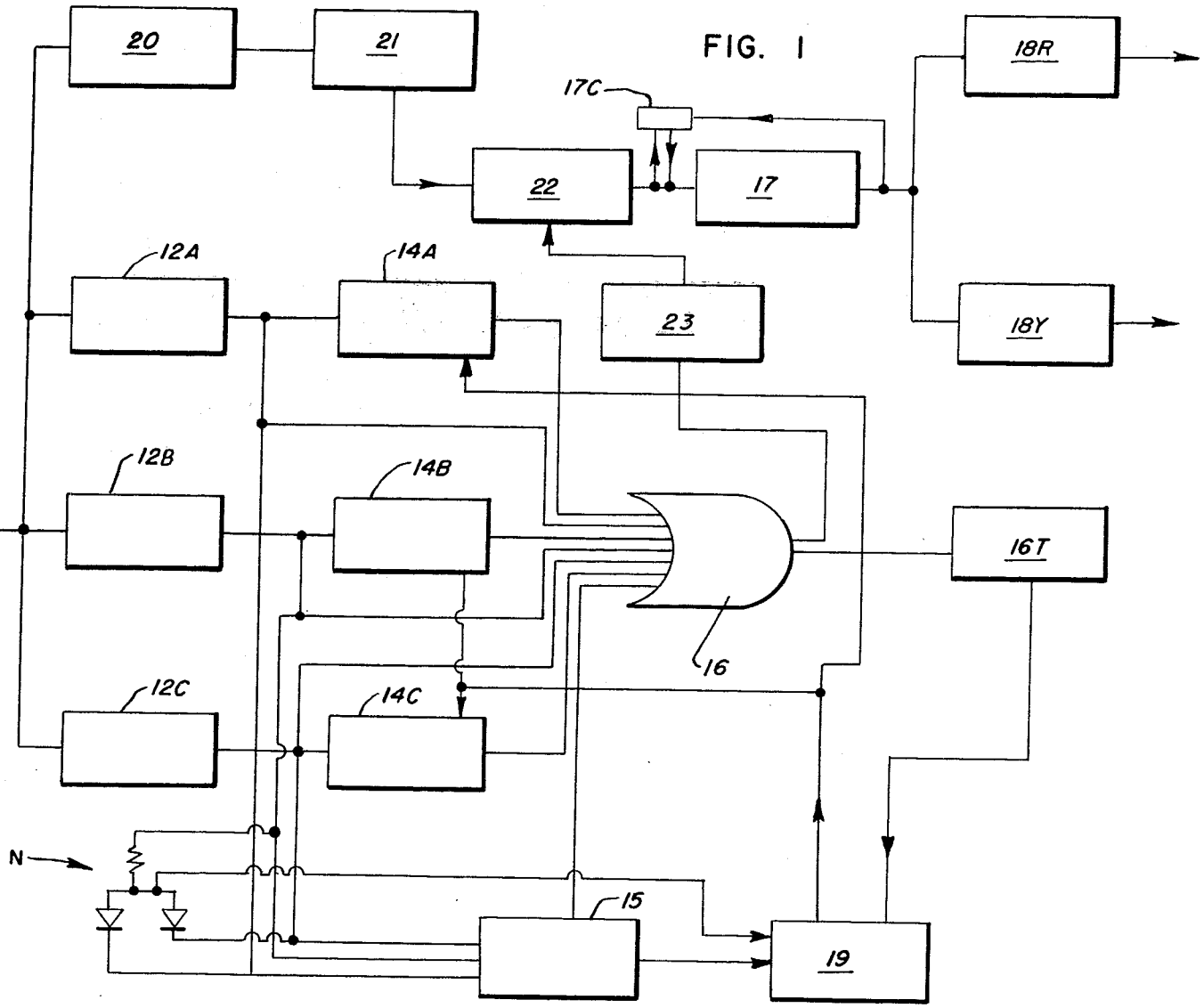
FIG. 1 is a block diagram of a composite system for detecting valid siren signals and controlling indicators such as traffic lights.

Referring now to the drawings, an audio range siren detector circuit is shown in FIG. 1 as including an audio pick-up means consisting of a conventional microphone 10 feeding an audio amplifier 11. The amplifier 11 may be of any suitable type but, preferably, it is of a wide dynamic range AGC type capable of operating with input signal amplitudes ranging from 1 milliwatt to 30 volts in order to allow for siren detection in a range of about three blocks to a few feet.

Output from the amplifier 11 is supplied to an array of narrow band pass filters 12 A, 12 B and 12 C having closely spaced resonance points and each preferably having a fast rise time. Each filter provides a rectified DC output.

Figure 2:
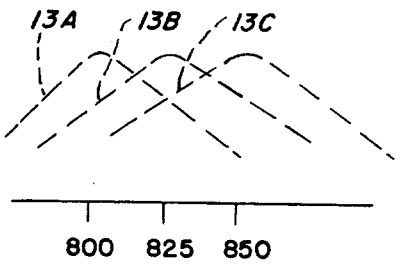
FIG. 2 shows typical frequency response curves for filter means tuned to closely spaced fundamental frequencies such as occur in a valid siren signal.

Each of the filters preferably consists of two stages of electronic active filter. Such filters are commercially available; for example, the type B-300 marketed by TRW is suitable. As shown by the response curves 13 A, 13 B and 13 C in FIG. 2, filter 12 A is accurately tuned to a frequency of 800 cycles, filter 12 B is accurately tuned to a frequency of 825 cycles and filter 12 C is accurately tuned to a frequency of 850 cycles.

Each of the filters 12 A, 12 B and 12 C has its output connected to a gating means 14 A, 14 B and 14 C, each connected so that it must lock as a prerequisite to a valid siren detection. Typically, each gating means may be a type 4013 flip-flop, which consists of a one-shot resettable multi-vibrator that responds to a pre-determined D.C. output from its corresponding filter to roll over and lock. When each gating means locks, it supplies an output signal until it is rolled back by a reset signal.

In the preferred practice of this invention, the beginning of the first signal response for either of the end frequencies (800 or 850 cycles) to be detected initiates a timing interval within which all of the designated frequency signal responses must begin and end. Thus, it is preferred that a valid siren signal detection requires either the sequence ABC or the sequence CBA. A signal timer 15 is connected to each of the filter means 12 A, 12 B, 12 C to be actuated by the first output signal for generating a timing signal that defines a predetermined time interval for completion of all signal responses.

Figure 3:
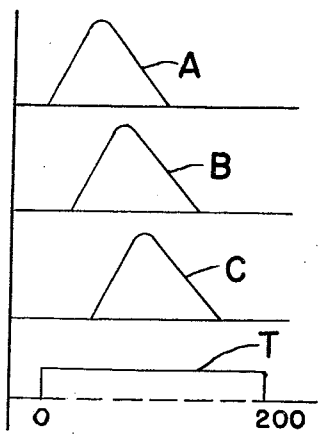
FIG. 3 shows a typical filter response pattern in the case of detection of a valid siren signal.

Typically, a time interval of 200 milliseconds is utilized as is shown by the time slot signal T in FIG. 3. The frequency signal repsonses A, B, C of the filters 12 A, 12 B and 12 C are all shown as going to zero in FIG. 3 prior to completion of the timing interval T. This is a requirement for a valid siren signal detection.

Control logic 16 composed of a number of 2-input NOR gates such as MOS-FET type 4002 functions as a multiple input NOR gate to provide the desired control function. Thus, the output from each of the filters 12 A, 12 B and 12 C and the output from each of the gating flip-flops 14 A, 14 B and 14 C and the output from the timer 15 are all connected as inputs to the control logic 16 which then provides a response upon the occurrence of a pre-determined signal pattern on each input within the duration of the 200 millisecond control signal from the timer.

In the described embodiment, the logic element 16 is only actuated in the case where a valid siren signal is detected. Thus, any sequence such as BAC or BCA is not detected by the main logic by providing for reset of the gating flip-flops during any sequence where B is the first detected frequency. A reset unit 19 is connected to each flip-flop 14 A, 14 B, 14 C. One of the inputs to reset unit 19 is taken from a network N that triggers the reset whenever frequency B occurs first in the sequence.

The control logic is connected to utilization circuitry, the principal element of which is the main timer 17 which typically may be adjusted to operate for an interval of from 20 seconds to 1 minute in order to actuate a pair of control relays 18 R, 18 Y. Relay 18 R is connected to all of the red lights at the traffic intersection to hold the same red and yellow lights to flash the same at a rapid rate. This light control system enables the operator of the emergency vehicle to know that the lights are locked red so that it is safe to swing into the left lane and zigzag through the crossing.

The main logic 16 on being actuated by a valid siren signal trips a trigger circuit 16 T that is connected to the reset unit 19 for applying a reset signal to each gating means to roll it back to its initial condition. In addition, the timer 15 is connected to the reset unit to apply a reset signal at the end of the timing interval.

Thus, whether or not a valid siren signal has been detected by the logic 16 within the 200 millisecond time slot of the signal timer, the signal timer 15 activates a reset unit 19 to reset the gates 14 A, 14 B, 14 C and restores the signal detection system to initial condition.

Once a valid siren detection has been established and the main timer 17 is actuated, each subsequent valid siren detection will reset it so that the traffic lights will be controlled as soon as the emergency vehicle siren is detected and will be maintained so long as the emergency vehicle is detected.

It should be apparent that the system will detect valid siren signals whether of increasing or decreasing frequency characteristics. Normally, a siren signal will sweep frequencies in customary numerical sequence, either up or down and it is most unlikely to initiate a center frequency response and then trigger the end frequency responses. It is possible, however, that extraneous noises or any combination thereof would produce such an anti-sequence frequency pattern.

The system as described thus far is not subject to false triggering from such an anti-sequence pattern. It is contemplated that false triggering of the type described can also be prevented by eliminating the connection line that applies output from filter 12 B to the slot timer 15. In such a modification, the network N and its connection to the reset 19 are also eliminated. Alternatively, the control logic 16 may be set so that should output from filter 12 B to logic 16 occur first, logic 16 actuates the reset unit 19 to reset the gating units 14 A, 14 B, 14 C.

The input to the main timer 17 is shown to include a resettable counter 17 C to provide a restriction on the valid siren indication such that two valid siren signals must be detected before the utilization means is actuated. The timer 17 is connected to reset its output counter 17 C after each count of two.

As shown in FIG. 1, the actuation of the utilzation means may also be restricted by including a signal change detector 20 connected to the output from the audio amplifier to actuate a resettable timer 21 which serves as one input to a NOR gate 22 that also receives input through a resettable timer 23 triggered from the main control logic 16. Each of the timers 21, 23 may have a time cycle of 0.5 seconds. The NOR gate 22 is shown connected to actuate the resettable counter 17 C (or the main timer 17, if no counter is employed) when timers 21, 23 are both operating. The signal change detector 20 and related timer circuitry enables a further criteria of siren detection to be incorporated in that actual siren characteristics due to standing wave effects and the like result in a large signal amplitude change which may also be included as a further prerequisite to actuating the main timer 17 for setting the traffic lights. In the absence of this additional feature, the output from the main logic 16 is connected directly to the input counter 17 C or the timer 17 as will be apparent to those skilled in the art.

Thus, while preferred constructional features of the invention are embodied in the structure illustrated herein, it is to be understood that changes and variations may be made by those skilled in the art without departing from the spirit and scope of the appended claims.

What is claimed is:

1. An audio range siren detector comprising audio pick-up means for transducing variable frequency audio signal energy into variable frequency electrical signal energy, narrow band signal producing means responsive to said audio pick-up means to produce separate outputs when predetermined closely spaced fundamental siren frequencies appear in said electrical signal energy, gated control means responsive to the signal producing means only upon pre-determined reduction of outputs therefrom within a limited time following initiation of any such output, and utilization means responsive to said gated control means.

2. An audio range siren detector as defined in claim 1 wherein said narrow band signal producing means comprises at least two narrow pass electronic filter means having closely spaced resonance points in the region of fundamental siren frequencies.

3. An audio range siren detector as defined in claim 1 whrein said narrow band signal producing means comprises at least three narrow pass electronic filter means having closely spaced resonance points in the region of fundamental siren frequencies, and wherein said gated control means includes timer means repsonsive to initiation of output from either the high resonance or the low resonance ones of said filter means for generating a limited time cycle, gating means responsive to each of said filter means for producing separate outputs upon initiation of the output from the corresponding filter means and control means responsive upon the occurrence of a pre-determined signal pattern comprised of all of the said outputs within the duration of the time cycle to actuate the utilization means.

4. An audio range siren detector as defined in claim 1 wherein said narrow band signal producing means comprises at least two narrow pass electronic filter means having closely spaced resonance points in the region of fundamental siren frequencies and wherein said gated control means includes timer means responsive to initiation of output from any of said filter means for generating a limited time cycle, gating means responsive to each of said filter means for producing separate outputs upon initiation of the output from the corresponding filter means and control means responsive upon the occurrence of a pre-determined signal pattern comprised of all of the said outputs within the duration of the time cycle to actuate the utilization means.

5. An audio range siren detector as defined in claim 1 and wherein said gated control means includes timer means responsive to initiation of output from said filter means for generating a limited time cycle, gating means responsive to each of said filter means for producing separate outputs upon initiation of the output from the corresponding filter means and control means responsive upon the occurrence of a pre-determined signal pattern comprised of all of the said outputs within the duration of the time cycle to actuate the utilization means.

6. An audio range siren detector as defined in claim 1 and including signal change detecting means responsive to said audio pick-up means and wherein said utilization means is responsive upon actuation by both said control means and said detecting means.

7. An audio range siren detector as defined in claim 1 wherein said audio pick-up means includes a microphone feeding an AGC amplifier.

8. An audio range siren detector as defined in claim 1 and including reset means responsive to the gated control means for resetting the same after each valid siren signal detection and said utilization means includes resettable timer means responsive to the gated control means upon each valid siren signal detection to delay actuation of the utilization means until a predetermined number of valid siren signals are detected.

* * * * *